US006612879B1

(12) United States Patent
Zahnen

(10) Patent No.: US 6,612,879 B1
(45) Date of Patent: Sep. 2, 2003

(54) ELECTRICAL CONNECTOR WITH OFFSET KEEPER HOLDERS AND ASSOCIATED METHODS

(75) Inventor: James L. Zahnen, Ormond Beach, FL (US)

(73) Assignee: Homac MFG. Company, Ormond Beach, FL (US)

( * ) Notice: Subject to any disclaimer, the term of this patent is extended or adjusted under 35 U.S.C. 154(b) by 0 days.

(21) Appl. No.: 10/264,405

(22) Filed: Oct. 4, 2002

(51) Int. Cl.[7] ..... H01R 11/09
(52) U.S. Cl. ..... 439/798
(58) Field of Search ..... 439/797, 798, 439/810, 813, 814, 812

(56) References Cited

U.S. PATENT DOCUMENTS

| | | | | |
|---|---|---|---|---|
| 2,222,156 A | * 11/1940 | Rovwe | 439/812 |
| D195,623 S | 7/1963 | Leonardo et al. | |
| 3,133,779 A | 5/1964 | Stanback | |
| 4,382,651 A | 5/1983 | Klosin et al. | 339/92 |
| D302,420 S | 7/1989 | McGrane | D13/24 |
| D309,664 S | 7/1990 | McGrane | D13/146 |
| D320,381 S | 10/1991 | McGrane | D13/147 |
| 5,269,710 A | 12/1993 | Donnerstag | 439/810 |
| D346,150 S | 4/1994 | Triantopoulos | D13/149 |
| D377,782 S | 2/1997 | Fillinger | D13/151 |
| 5,690,516 A | 11/1997 | Fillinger | 439/798 |
| 5,931,708 A | 8/1999 | Annas et al. | 439/798 |
| 6,203,384 B1 | 3/2001 | DeFrance | 439/798 |
| 2002/0094729 A1 | 7/2002 | Triantopoulos et al. | 439/798 |

OTHER PUBLICATIONS

The Homac Companies catalogue on "Quality Electrical Connectors and Accessories"; pp. 10 and 11.

* cited by examiner

*Primary Examiner*—Lynn Feild
*Assistant Examiner*—Phuong Dinh
(74) *Attorney, Agent, or Firm*—Allen, Dyer, Doppelt, Milbrath & Gilchrist, P.A.

(57) ABSTRACT

Abstract of the Disclosure An electrical connector for connecting a plurality of electrical conductors to a transformer conductor, such as in a confined space, includes a generally rectangular flat base with offset keeper holders extending from opposite sides of the base. The base has opposing first and second ends and a medial portion extending therebetween. The first end is to be connected to the transformer conductor, while electrical conductors are to be connected to the second end. The electrical connector includes at least one medial keeper holder extending outwardly from a first side of the medial portion of the base, and at least one medial keeper received in the at least one medial keeper holder to secure an electrical conductor therein. At least one end keeper holder extends outwardly from a second side of the second end of the base and is longitudinally offset and on an opposite side from the at least one medial keeper holder. At least one end keeper is received in the end keeper holder to secure an electrical conductor therein.

42 Claims, 8 Drawing Sheets

ELECTRICAL CONNECTOR WITH OFFSET KEEPER HOLDERS AND ASSOCIATED METHODS

FIELD OF THE INVENTION

The present invention relates to the field of electrical connectors, and, more particularly, to electrical connectors for connecting electrical conductors to transformer conductors and associated methods.

BACKGROUND OF THE INVENTION

In electrical power distribution systems, electrical conductors or cables are generally connected to a transformer conductor via an electrical connector. A transformer may include a plurality of spaced apart transformer conductors, such as in the form of blades. Unfortunately, the available space between adjacent transformer conductors, such as within a transformer cabinet or housing, may be limited. Accordingly, it may be difficult install the electrical connectors in this confined space.

U.S. Design Pat. No. 320,381 to McGrane represents a significant advance in the technology and discloses one such electrical connector. The electrical connector includes a first end that connects to the transformer conductor, and a second end having a plurality of electrical conductor receiving passageways for receiving electrical conductors therein. A plurality of fastener receiving passageways are provided for receiving a plurality of fasteners therein to secure electrical conductors in the electrical conductor receiving passageways. It may be somewhat difficult, however, for an installer to manipulate the relatively large diameter electrical conductors into the respective openings. In addition, it may also be difficult to position tools necessary for tightening and loosening the fasteners within the confined space.

Other significant advances in the technology are represented by electrical connectors currently offered by Homac Mfg. Company of Ormond Beach, Florida under the series designation EZ KEEPER™. These electrical connectors include a generally rectangular flat base having a plurality of keeper holders connected thereto. Keepers are received in the keeper holders. Fasteners extend through the keepers to secure the electrical conductors in the keeper holders. The keepers allow for easier positioning of the relatively large gauge electrical cables, as the keepers can be removed during this phase of installation. Stops have been provided to prevent the keepers from sliding out of the bottom of the holders. The stops have been provided in the form of a displaced tab on the upper end of the keeper. Unfortunately, manufacturing uniformity may be difficult for this stop.

To accommodate additional electrical conductors, two EZ KEEPER™ connectors have been aligned in back-to-back configuration, for example, or a model ABK 41000 includes keeper holders welded to the base on directly opposite sides. While the EZ KEEPER™ connectors represent a significant advance, in limited space applications it may still be difficult to position tools for securing the fasteners for the keepers.

SUMMARY OF THE INVENTION

In view of the foregoing background, it is therefore an object of the present invention to provide an electrical connector and methods for more efficiently connecting a plurality of electrical conductors to transformer conductors, such as in a confined space.

This and other objects, features and advantages of the present invention are provided by an electrical connector comprising a generally rectangular flat base with offset keeper holders extending from opposite sides of the base. More particularly, the base may have opposing first and second ends and a medial portion extending therebetween. The first end may be connected to the transformer conductor. The electrical connector may also comprise at least one medial keeper holder extending outwardly from a first side of the medial portion of the base, and a medial keeper received therein to secure an electrical conductor.

The electrical connector may further comprise at least one end keeper holder extending outwardly from a second side of the second end of the base, and an end keeper received therein to secure an electrical conductor. In other words, the at least one end keeper holder may be longitudinally offset and on an opposite side of the base from the at least one medial keeper holder. The offset and opposite position of the keeper holders advantageously provides space for an installer to manipulate tools necessary to secure the fasteners to secure the keepers in the respective keeper holders.

The at least one medial keeper may have a medial fastener receiving passageway therein. A medial fastener may be received in the medial fastener receiving passageway. In other embodiments, the medial portion of the base may have a medial fastener receiving passageway therein and a medial fastener may be received in the medial fastener receiving passageway. In other words, the fasteners for the medial keeper holders may extend through either the keepers or through the base. The at least one end keeper may have an end fastener receiving passageway therein, and the electrical connector may further comprise an end fastener received in the end fastener receiving passageway.

Each keeper holder may have a pair of opposing keeper receiving recesses therein to slidably receive a respective keeper. Further, at least one end stop may be associated with the opposing keeper receiving recesses to prevent the respective keepers from sliding outwardly therepast. The medial keeper holder may have an arcuate bottom raised above a level of the first side of the second end of the base to advantageously allow ready positioning of electrical conductors including surrounding insulation. Similarly, the end keeper holder may also have an arcuate bottom recessed below a level of the second side of the second end of the base to also advantageously allow ready positioning of electrical conductors having surrounding insulation.

The base may further have at least one fastener receiving passageway through the first end thereof for fasteners to connect to the transformer conductor. The base, the medial keeper holder, and the end keeper holder may be integrally formed as a monolithic unit in some embodiments. Further, the base, the medial keeper holder, the medial keeper, the end keeper holder, and the end keeper may comprise aluminum, for example.

A method aspect of the present invention is for making an electrical connector for connecting a plurality of electrical conductors to a transformer conductor. The method may comprise forming at least one medial keeper holder extending outwardly from a first side of a medial portion of the base, and forming at least one end keeper holder extending outwardly from a second side of the second end of the base to be longitudinally offset and on an opposite side from the at least one medial keeper holder. The method may further include providing at least one medial keeper to be received in the medial keeper holder, and providing at least one end keeper to be received in the end keeper holder to secure respective electrical conductors therein.

DETAILED DESCRIPTION OF THE PREFERRED EMBODIMENTS

Figure 1:
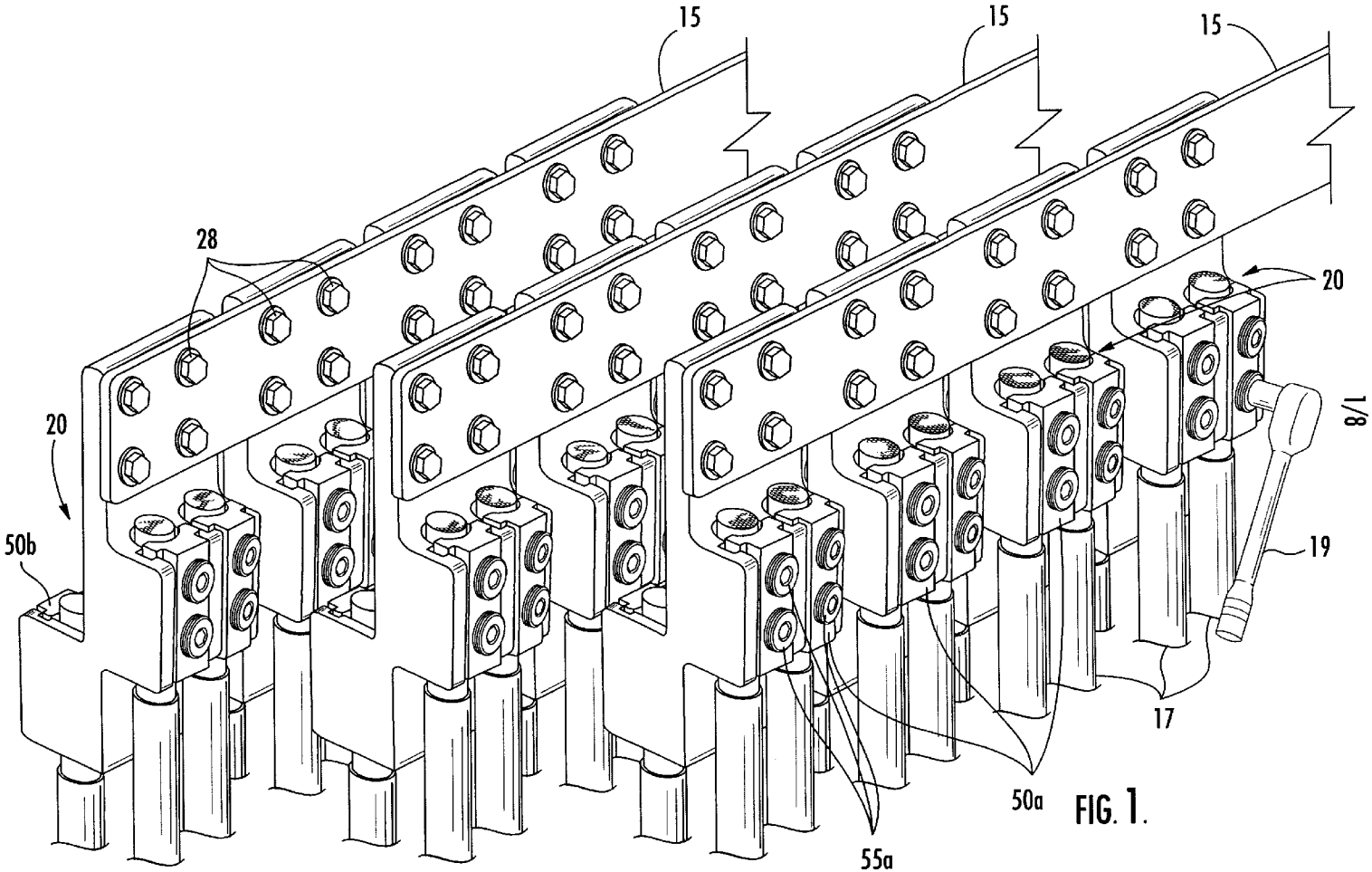
FIG. 1 is a perspective view of a plurality of electrical connectors connected to a plurality of transformer conductors according to the present invention.
Figure 2:
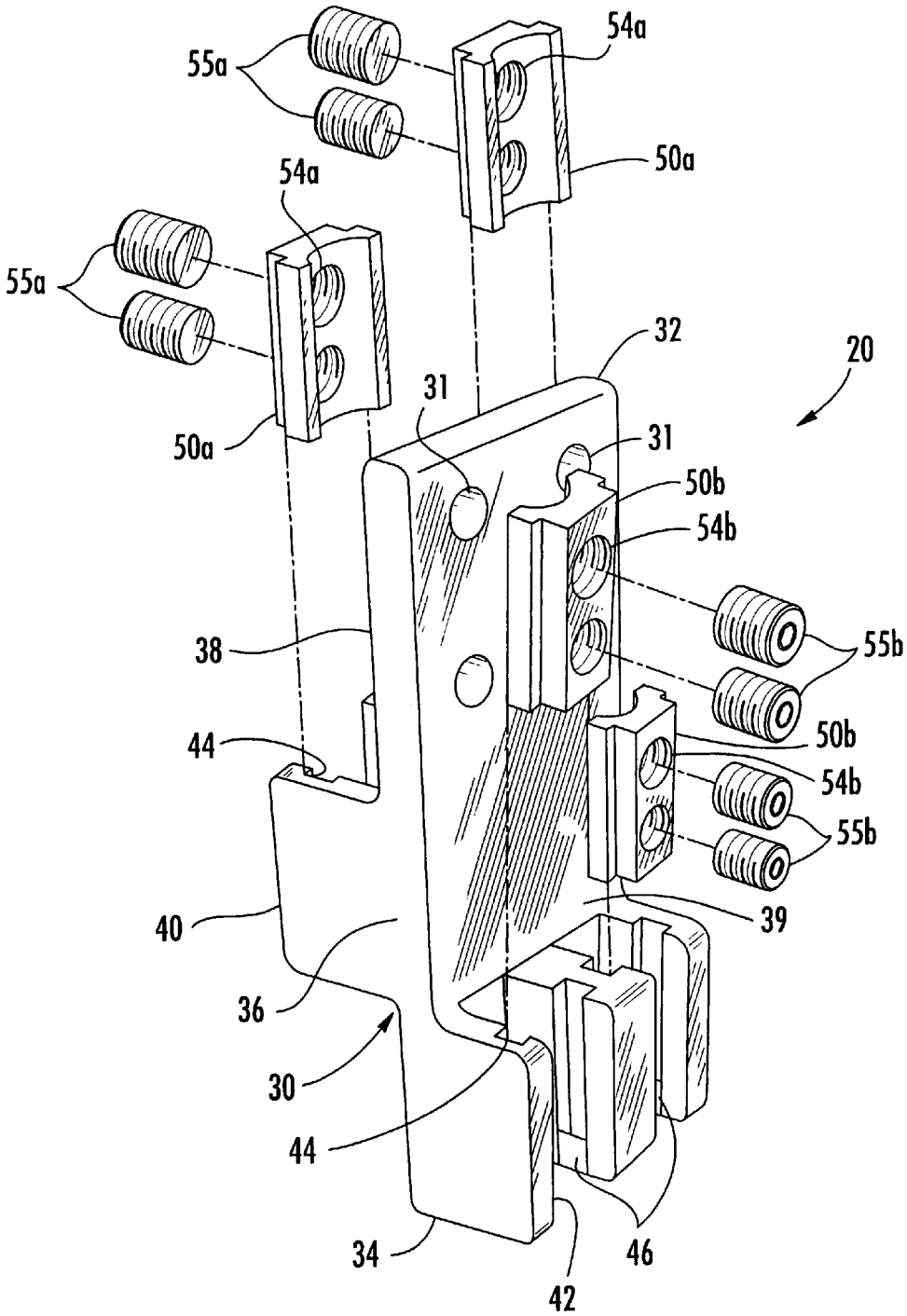
FIG. 2 is an exploded view of one of the electrical connectors shown in FIG. 1.
Figure 3:
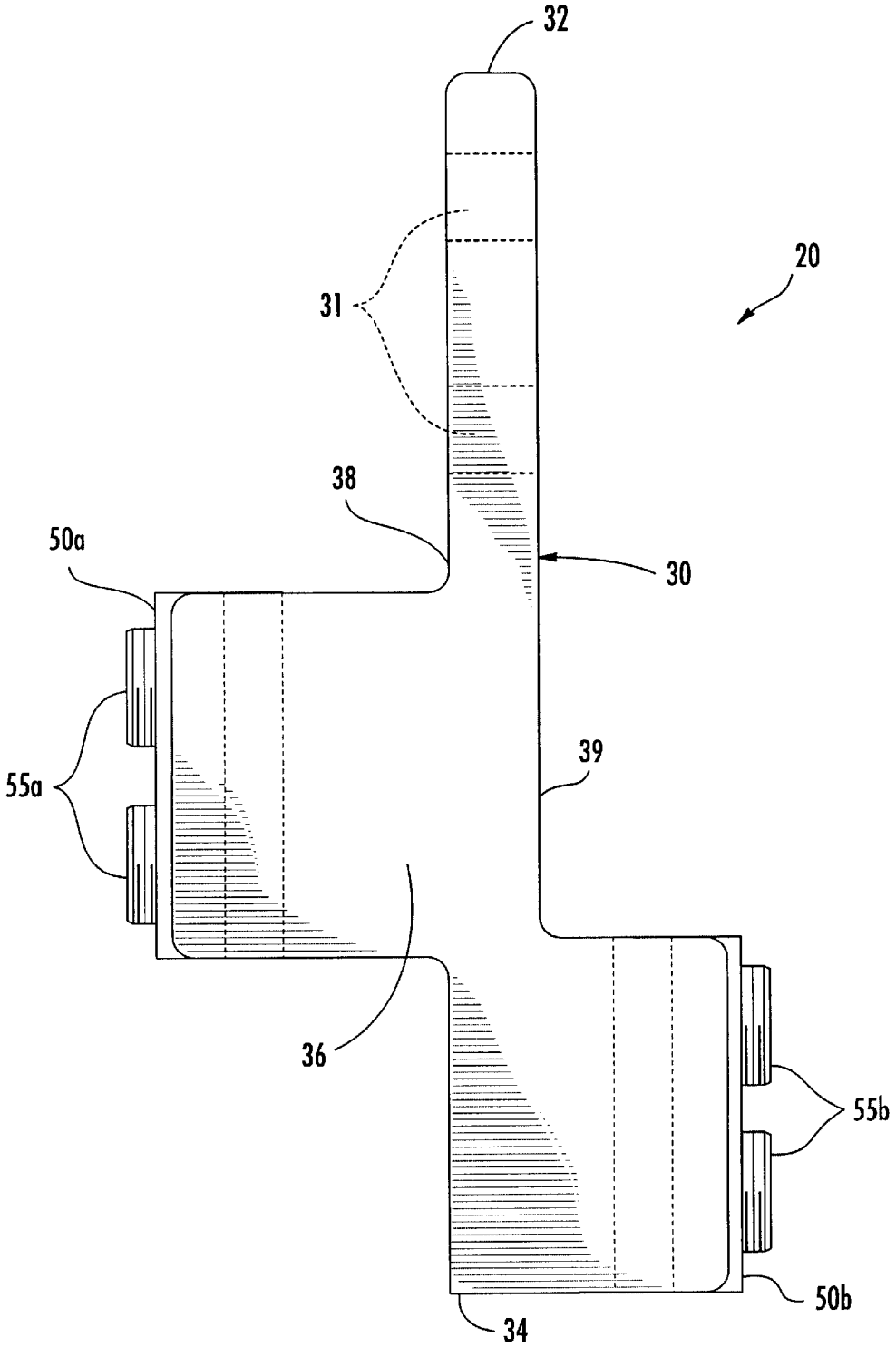
FIG. 3 is a side view of the electrical connector shown in FIG. 2.
Figure 4:
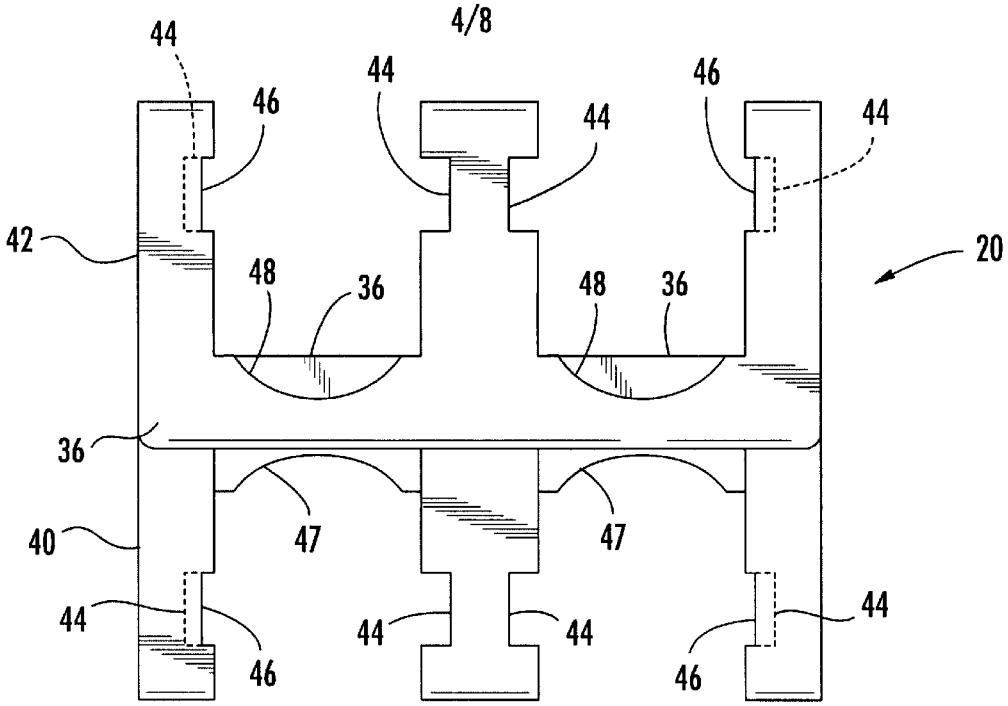
FIG. 4 is a bottom end view of the electrical connector shown in FIG. 2.
Figure 5:
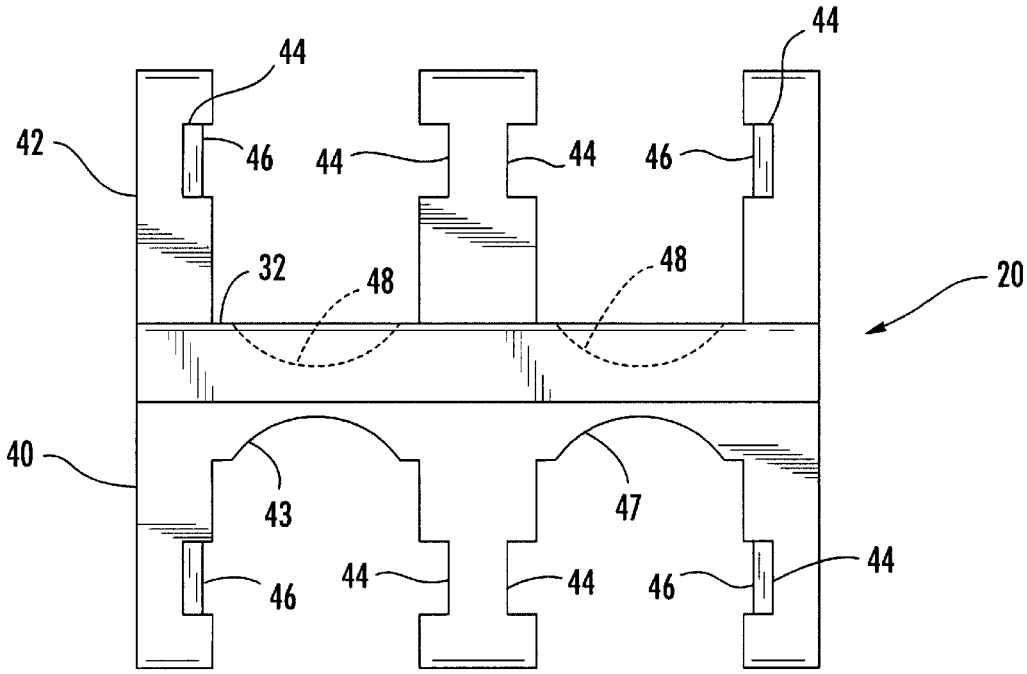
FIG. 5 is a top end view of the electrical connector shown in FIG. 2.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime notation is used to indicate similar elements in alternate embodiments.

Referring initially to FIGS. 1–5, an electrical connector 20 for connecting a plurality of electrical conductors 17 to a transformer conductor 15 is now described. The electrical connector 20 advantageously includes offset keeper holders 40, 42 to allow for more efficient connecting of electrical conductors 17 to transformer conductors 15 in a confined space, such as within a cabinet, for example.

The electrical connector 20 illustratively includes a generally rectangular flat base 30 having a first end 32, an opposing second end 34, and a medial portion 36 extending therebetween. The first end 32 of the base 30 is illustratively connected to the transformer conductor 15. In the illustrated embodiment of FIG. 1, a plurality of electrical connectors 20 are connected to each transformer conductor 15 in side-by-side relation. The base 30 may, for example, comprise aluminum, or any other material having similar lightweight and high strength properties as understood by those skilled in the art.

The offset keeper holders include medial keeper holders 40, and end keeper holders 42. More specifically, a pair of medial keeper holders 40 extend outwardly from a first side 38 of the medial portion 36 of the base 30 of the electrical connector 20. A pair of medial keepers 50*a* are illustratively received in the respective pair of medial keeper holders 40 to secure electrical conductors 17 therein.

A pair of end keeper holders 42 extend outwardly from a second side 39 of the second end 34 of the base 30. A pair of end keepers 50*b* are illustratively received in the respective pair of end keeper holders 42 also to secure electrical conductors 17 therein. Although the illustrated conductor 20 includes a pair of medial keeper holders 40 and a pair of end keeper holders 42, as well as their associated keepers 50*a*, 50*b* those skilled in the art will appreciate that the electrical connector 20 may include any number of keeper holders and associated keepers.

As indicated above, the pair of end keeper holders 42 are illustratively longitudinally offset and on an opposite side from the pair of medial keeper holders 40. In the illustrated embodiment, the offset is provided where the end keeper holders 42 stop and where the medial keeper holders 40 begin. The amount of offset could be greater or less than this in other embodiments as will be appreciated by those skilled in the art. The offset and opposite position of the keeper holders 40, 42 advantageously provides additional space for the positioning of appropriate tools, such as the ratchet 19 (FIG. 1), to tighten fasteners 55*a*, 55*b*, for example.

The medial keeper holders 40 and the end keeper holders 42 each illustratively include a pair of opposing keeper receiving recesses 44 therein to slidably receive the respective keepers 50*a*, 50*b*. The keeper holders 40, 42 also each illustratively include a pair of end stops 46 associated with the keeper receiving recesses 44 to prevent the keepers 50*a*, 50*b* from sliding outwardly therepast. The end stops 46 may be formed by stopping the advancement of a circular cutter just prior to passing completely past the lower end so that a slightly curved residual portion of metal is left as the end stop. Other approaches may also be used. This configuration advantageously allows the installer to slide the keepers 50*a*, 50*b* to the end stops 46 without the keepers sliding downwardly to the floor.

Each medial keeper holder 40 illustratively includes an arcuate bottom 47 raised above a level of the first side 38 of the second end 34 of the base 30. Similarly, the end keeper holder 42 illustratively includes an arcuate bottom 48 recessed below a level of the second side of the second end of the base 30. Electrical conductors 17 typically include inner conductors and surrounding insulation. Accordingly, the raised arcuate bottom 47 advantageously provides additional clearance for the insulation along the first side 38 of the second end 34 of the base 30. No such clearance is needed for the conductors 17 received in the end keeper holders 42 as will be appreciated by those skilled in the art.

The base 30 of the electrical connector 20 further illustratively has a plurality of fastener receiving passageways 31 through the first end 32 thereof for connecting to the transformer conductor 15. More specifically, the transformer conductor 15 includes a plurality of fastener receiving passageways that can be aligned with the fastener receiving passageways 31 on the base 30. Fasteners 28 may be used to secure the electrical connector 20 to the transformer conductor 15. The fasteners 28, for example, may be bolts and nuts, as shown in the illustrated embodiment, although other fasteners may also be used as understood by those skilled in the art.

The base 30, the medial keeper holders 40 and the end keeper holders 42 of the electrical connector 20 may be integrally formed as a monolithic unit. The base 30, the medial keeper holders 40, the medial keepers 50*a*, the end keeper holders 42 and the end keepers 50*b*, may comprise aluminum, for example, or another material having similar strength and electrical properties as understood by those skilled in the art. Of course, in other embodiments the keeper holders 40, 42 can be formed separately, and thereafter joined to the base 30.

Figure 6:
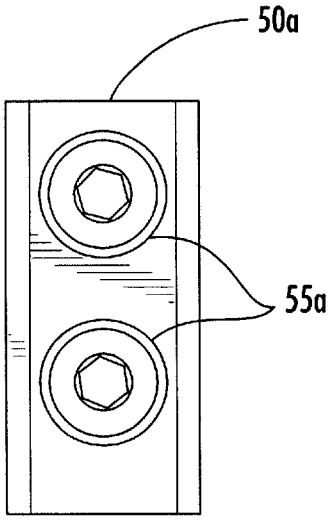
FIG. 6 is a top view of a keeper of the electrical connector shown in FIG. 2.
Figure 7:
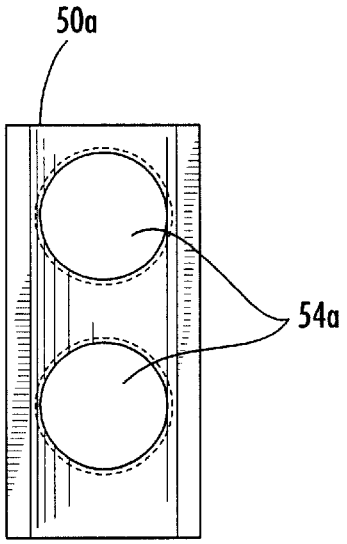
FIG. 7 is a bottom view of the keeper shown in FIG. 6 with the fasteners removed for clarity.
Figure 8:
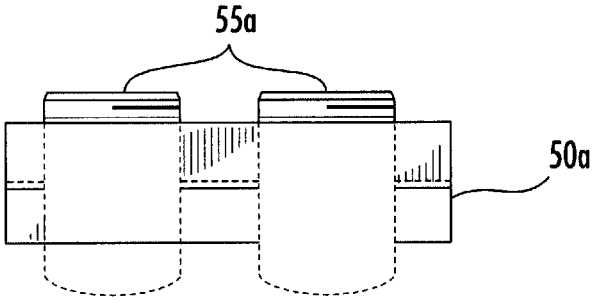
FIG. 8 is a side view of the keeper shown in FIG. 7.
Figure 9:
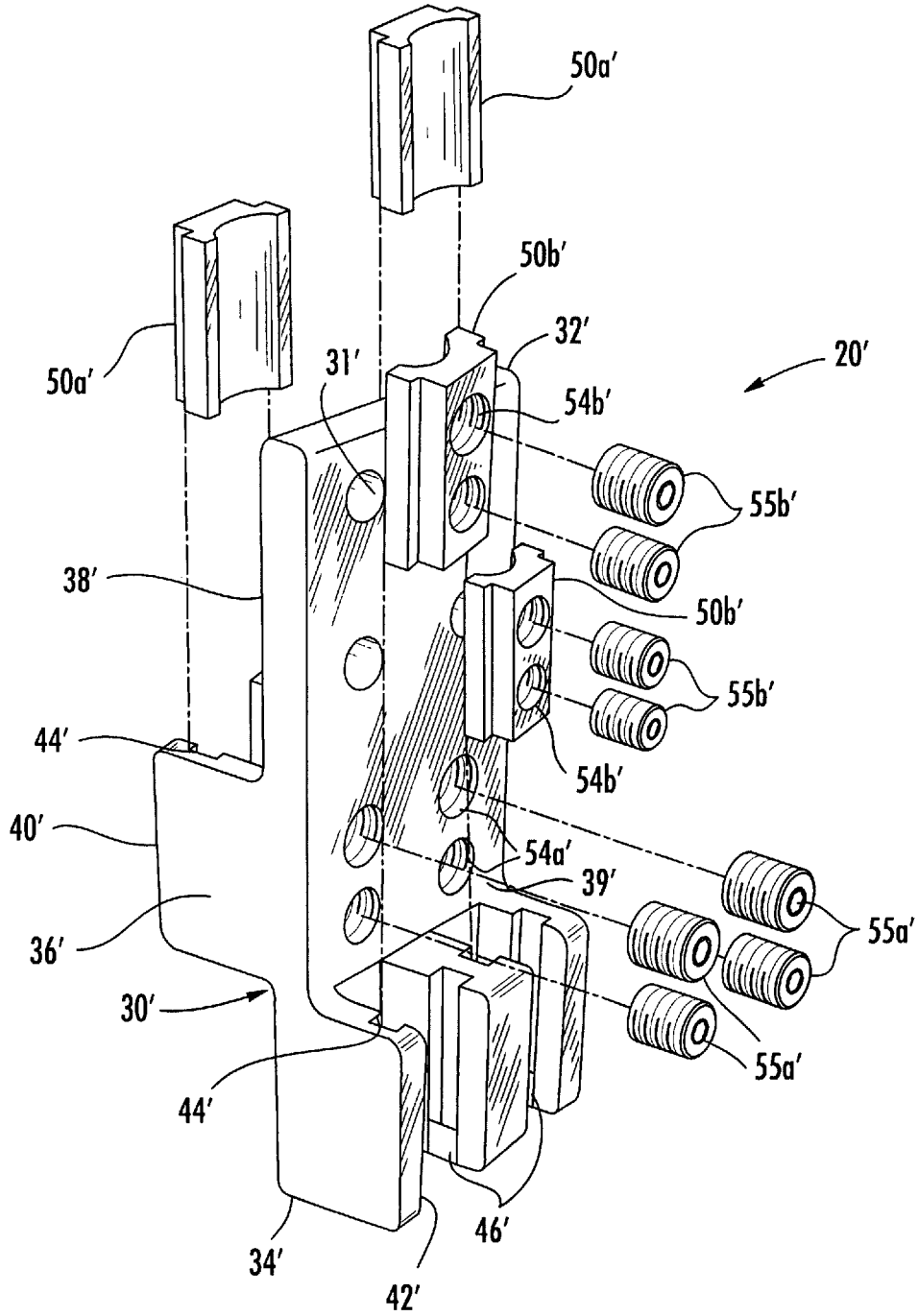
FIG. 9 is an exploded view of another embodiment of the electrical connector according to the present invention.
Figure 10:
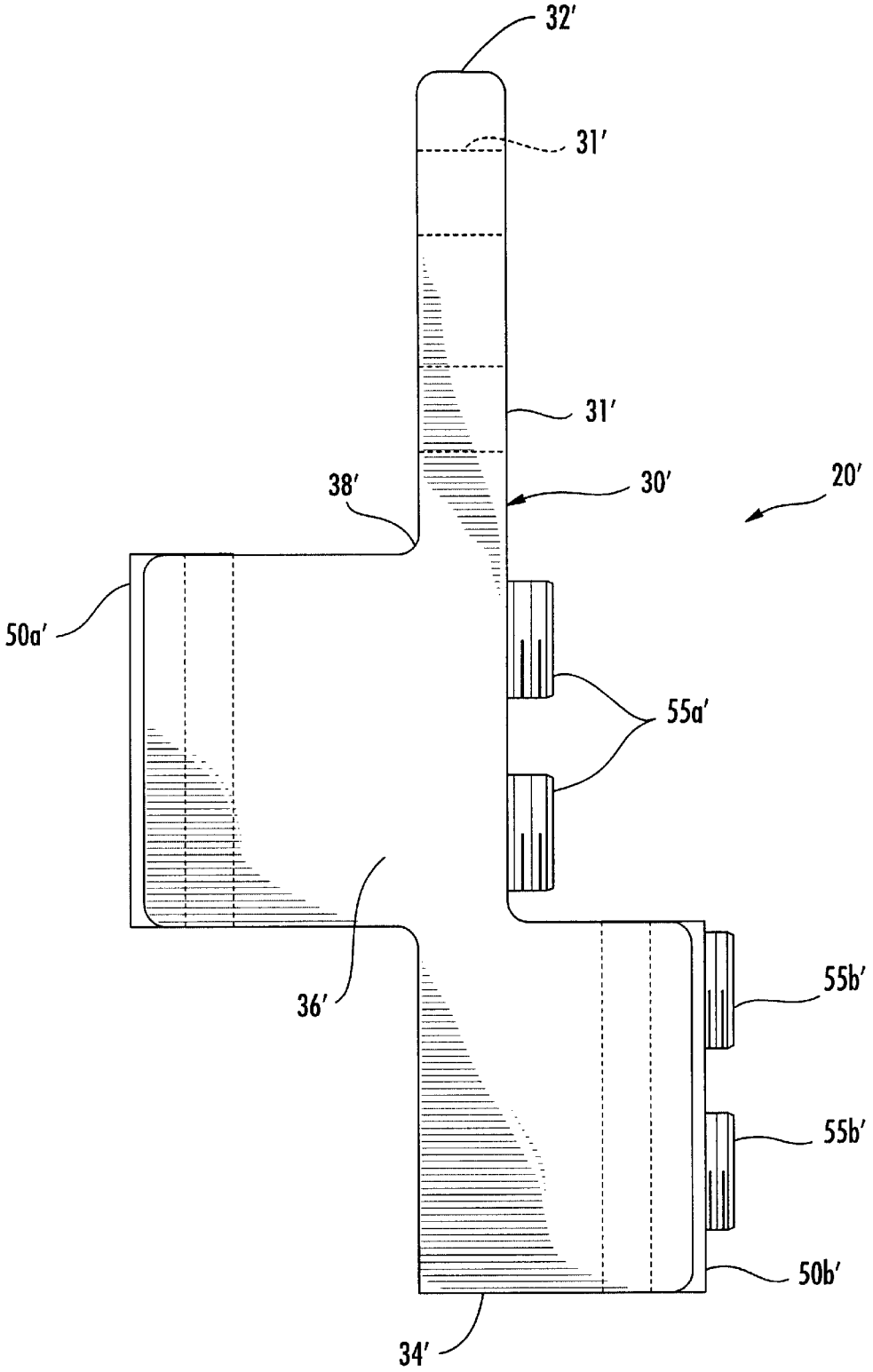
FIG. 10 is a side view of the electrical connector shown in FIG. 9.
Figure 11:
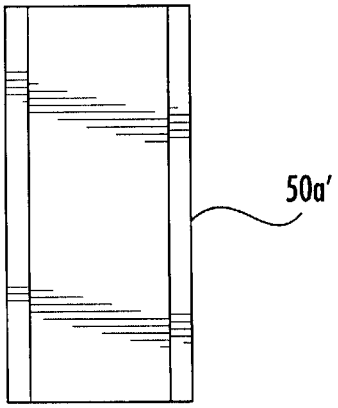
FIG. 11 is a top view of a keeper of the electrical connector shown in FIG. 9.
Figure 12:
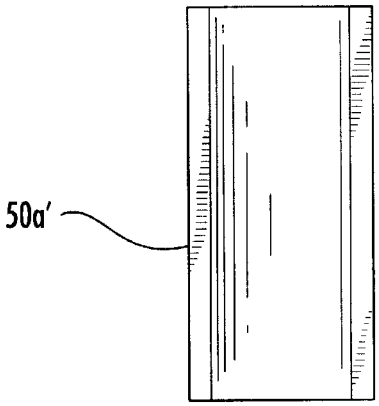
FIG. 12 is a bottom view of the keeper shown in FIG. 11.
Figure 13:
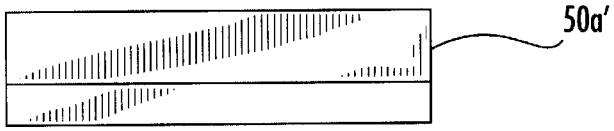
FIG. 13 is a side view of the keeper shown in FIG. 11.

Turning now additionally to FIGS. 6–8, the keepers 50*a*, 50*b* are now described. For simplicity only the medial keeper 50*a* is described in detail. More specifically, the keeper 50*a* illustratively includes a body having a pair of threaded fastener receiving passageways therein. A pair of fasteners 55*a* are received in the passageways 54*a*. The keeper 50*a* includes opposing edges which are slidably received in the recesses in 44.

Turning now more specifically to FIGS. 9–13, a second embodiment of the electrical connector 20' is now described. In the second embodiment of the electrical connector 20', the medial portion of the base 36' illustratively has the medial fastener receiving passageways 54' therein rather than the medial keepers 50*a*'. Indeed, the medial keepers 50*a*' can be provided without passageways as understood with reference to FIGS. 11–13. The medial fasteners 55*a*' extend inwardly from the second side 39' of the medial portion 36' of the base 30' to urge the conductor outwardly against the keeper 50*a*' as will be appreciated by those skilled in the art. A pair of medial fasteners 55*a*' are illustratively received in the medial fastener receiving passageway 54' for fastening the electrical conductors 17' in the medial keeper holders 40'. This connector 20' embodiment allows access to both the medial and end fasteners 55*a*', 55*b*', from a common side of the connector. The other elements of the second embodiment of the electrical connector 20' are similar to those of the first embodiment, are identified using prime notation, and require no further discussion herein.

Referring again to FIGS. 1–8, a method aspect of the present invention is for making an electrical connector 20 for connecting the plurality of electrical conductors 17 to the transformer conductor 15. The method may include forming a body to have the generally rectangular flat base 30 with opposing first and second ends 32, 34 and a medial portion 36 extending therebetween. The method may also include forming a raised medial portion into the medial keeper holder(s) 40 extending outwardly from the first side 38 of the medial portion 36 of the base 30, and forming a raised second end 34 into the end keeper holder(s) 42 extending outwardly from the second side 39 of the second end 34 of the base 30 to be longitudinally offset and on an opposite side from the medial keeper holder. The method further includes providing one or more medial keepers 50*a* to be received in the medial keeper holder(s) 40 to secure an electrical conductor 17 therein, and providing one or more end keepers 50*b* to be received in the end keeper holder(s) 42 to secure an electrical conductor therein.

In some embodiments, forming the body may comprise extruding the body. The method may also include forming the pair of opposing keeper receiving recesses 44 in the keeper holders 40, 42 and end stops 46 associated with the keeper receiving recesses.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An electrical connector for connecting a plurality of electrical conductors to a transformer conductor, the electrical connector comprising:

a generally rectangular flat base having opposing first and second ends and a medial portion extending therebetween, the first end to be connected to the transformer conductor;

at least one medial keeper holder extending outwardly from a first side of the medial portion of said base;

at least one medial keeper removably received in said at least one medial keeper holder to secure at least one electrical conductor therein;

at least one end keeper holder extending outwardly from a second side of the second end of said base to be longitudinally offset and on an opposite side from said at least one medial keeper holder; and at least one end keeper removably received in said at least one end keeper holder to secure at least one electrical conductor therein.

2. An electrical connector according to claim 1 wherein said at least one medial keeper has at least one medial fastener receiving passageway therein; and further comprising at least one medial fastener received in the at least one medial fastener receiving passageway.

3. An electrical connector according to claim 1 wherein the medial portion of said base has at least one medial fastener receiving passageway therein; and further comprising at least one medial fastener received in the at least one medial fastener receiving passageway.

4. An electrical connector according to claim 1 wherein said at least one end keeper has at least one end fastener receiving passageway therein; and further comprising at least one end fastener received in the at least one end fastener receiving passageway.

5. An electrical connector according to claim 1 wherein each keeper holder further comprises a pair of opposing keeper receiving recesses therein to slidably receive a respective keeper.

6. An electrical connector according to claim 5 wherein each keeper holder further comprises an end stop associated with the opposing keeper receiving recesses to prevent the respective keeper from sliding outwardly therepast.

7. An electrical connector according to claim 1 wherein said at least one medial keeper holder has an arcuate bottom raised above a level of the first side of the second end of said base.

8. An electrical connector according to claim 1 wherein said at least one end keeper holder has an arcuate bottom recessed below a level of the second side of the second end of said base.

9. An electrical connector according to claim 1 wherein said base further comprises at least one fastener receiving passageway through the first end thereof for connecting to the transformer conductor.

10. An electrical connector according to claim 1 wherein said base, said at least one medial keeper holder, and said at least one end keeper holder are integrally formed as a monolithic unit.

11. An electrical connector according to claim 1 wherein said base, said at least one medial keeper holder, said at least one medial keeper, said at least one end keeper holder, and said at least one end keeper comprise aluminum.

12. An electrical connector for connecting a plurality of electrical conductors to a transformer conductor, the electrical connector comprising:

a generally rectangular flat base having opposing first and second ends and a medial portion extending therebetween, the first end to be connected to the transformer conductor;

a plurality of medial keeper holders extending outwardly from a first side of the medial portion of said base;

a plurality of medial keepers received in said medial keeper holders to secure electrical conductors therein;

a plurality of end keeper holders extending outwardly from a second side of the second end of said base to be longitudinally offset and on an opposite side from said medial keeper holders;

a plurality of end keepers received in said end keeper holders to secure electrical conductors therein;

each keeper holder having a pair of opposing keeper receiving recesses therein to slidably receive a respective keeper; and each keeper holder further comprising an end stop associated with the opposing keeper receiving recesses to prevent the respective keeper from sliding outwardly therepast.

13. An electrical connector according to claim 12 wherein each of said plurality of medial keeper has at least one medial fastener receiving passageway therein; and further comprising at least one medial fastener received in the at least one medial fastener receiving passageway.

14. An electrical connector according to claim 12 wherein the medial portion of said base has at least one medial fastener receiving passageway therein; and further comprising at least one medial fastener received in the at least one medial fastener receiving passageway.

15. An electrical connector according to claim 12 wherein each of said plurality of end keepers has at least one end fastener receiving passageway therein; and further comprising at least one end fastener received in the at least one end fastener receiving passageway.

16. An electrical connector according to claim 12 wherein each of said plurality of medial keeper holders has an arcuate bottom raised above a level of the first side of the second end of said base.

17. An electrical connector according to claim 12 wherein each of said plurality of end keeper holders has an arcuate bottom recessed below a level of the second side of the second end of said base.

18. An electrical connector according to claim 12 wherein said base further comprises a plurality of fastener receiving passageways through the first end thereof for connecting to the transformer conductor.

19. An electrical connector for connecting a plurality of electrical conductors to a transformer conductor, the electrical connector comprising:

a generally rectangular flat base having opposing first and second ends and a medial portion extending therebetween, the first end to be connected to the transformer conductor;

a plurality of medial keeper holders extending outwardly from a first side of the medial portion of said base, each medial keeper holder having an arcuate bottom raised above a level of the first side of the second end of said base;

a plurality of medial keepers removably received in said medial keeper holders to secure electrical conductors therein;

a plurality of end keeper holders extending outwardly from a second side of the second end of said base to be longitudinally offset and on an opposite side from said medial keeper holders, each end keeper holder having an arcuate bottom recessed below a level of the second side of the second end of said base; and a plurality of end keepers removably received in said end keeper holders to secure electrical conductors therein.

20. An electrical connector according to claim 19 wherein each of said plurality of medial keepers has at least one medial fastener receiving passageway therein; and further comprising at least one medial fastener received in the at least one medial fastener receiving passageway.

21. An electrical connector according to claim 19 wherein the medial portion of said base has at least one medial fastener receiving passageway therein; and further comprising at least one medial fastener received in the medial fastener receiving passageway.

22. An electrical connector according to claim 19 wherein each of said plurality of end keepers has at least one end fastener receiving passageway therein; and further comprising at least one end fastener received in the at least one end fastener receiving passageway.

23. An electrical connector according to claim 19 wherein said base further comprises a plurality of fastener receiving passageways through the first end thereof for connecting to the transformer conductor.

24. A method for making an electrical connector for connecting a plurality of electrical conductors to a transformer conductor, the method comprising:

forming a body to have a generally rectangular flat base with opposing first and second ends and a medial portion extending therebetween, and with a raised medial portion on a first side and a raised second end on a second side;

forming the raised medial portion into at least one medial keeper holder extending outwardly from the first side of the medial portion of the base;

forming the raised second end into at least one end keeper holder extending outwardly from the second side of the second end of the base to be longitudinally offset and on an opposite side from the at least one medial keeper holder;

providing at least one medial keeper to be removably received in the at least one medial keeper holder to secure at least one electrical conductor therein; and providing at least one end keeper to be removably received in the at least one end keeper holder to secure at least one electrical conductor therein.

25. A method according to claim 24 wherein forming the body comprises extruding the body.

26. A method according to claim 24 further comprising:

forming at least one medial fastener receiving passageway in the at least one medial keeper; and positioning at least one medial fastener in the at least one medial fastener receiving passageway.

27. A method according to claim 24 further comprising:

forming at least one medial fastener receiving passageway in the medial portion of the base; and positioning at least one medial fastener in the medial fastener receiving passageway.

28. A method according to claim 24 further comprising:

forming at least one end fastener receiving passageway in the at least one end keeper; and positioning at least one end fastener in the at least one end fastener receiving passageway.

29. A method according to claim 24 wherein forming the keeper holders comprises forming each keeper holder to have a pair of opposing keeper receiving recesses therein to slidably receive a respective keeper.

30. A method according to claim 29 wherein forming each keeper holder further comprises forming each keeper holder to have an end stop associated with the opposing keeper receiving recesses to prevent the respective keeper from sliding outwardly therepast.

31. A method according to claim 24 wherein forming the at least one medial keeper holder comprises forming the at least one medial keeper holder to have an arcuate bottom raised above a level of the first side of the second end of the base.

32. A method according to claim 24 wherein forming the at least one end keeper holder comprises forming the at least one end keeper holder to have an arcuate bottom recessed below a level of the second side of the second end of the base.

33. A method according to claim 24 further comprising forming at least one fastener receiving passageway through the first end of the base for connecting to the transformer conductor.

34. A method for making an electrical connector for connecting a plurality of electrical conductors to a transformer conductor, the method comprising:

forming at least one medial keeper holder extending outwardly from a first side of a medial portion of a base, the base having a first end to be connected to the transformer conductor and a second end;

forming at least one end keeper holder extending outwardly from a second side of the second end of the base to be longitudinally offset and on an opposite side from the at least one medial keeper holder;

providing at least one medial keeper to be removably received in the at least one medial keeper holder to secure at least one electrical conductor therein; and providing at least one end keeper to be removably received in the at least one end keeper holder to secure at least one electrical conductor therein.

35. A method according to claim 34 further comprising:

forming at least one medial fastener receiving passageway in the at least one medial keeper; and positioning at least one medial fastener in the at least one medial fastener receiving passageway.

36. A method according to claim 34 further comprising:

forming at least one medial fastener receiving passageway in the medial portion of the base; and positioning at least one medial fastener in the medial fastener receiving passageway.

37. A method according to claim 34 further comprising:

forming at least one end fastener receiving passageway in the at least one end keeper; and positioning at least one end fastener in the at least one end fastener receiving passageway.

38. A method according to claim 34 wherein forming the keeper holders comprises forming each keeper holder to have a pair of opposing keeper receiving recesses therein to slidably receive a respective keeper.

39. A method according to claim 38 wherein forming each keeper holder further comprises forming each keeper holder to have an end stop associated with the opposing keeper receiving recesses to prevent the respective keeper from sliding outwardly therepast.

40. A method according to claim 34 wherein forming the at least one medial keeper holder comprises forming the at least one medial keeper holder to have an arcuate bottom raised above a level of the first side of the second end of the base.

41. A method according to claim 34 wherein forming the at least one end keeper holder comprises forming the at least one end keeper holder to have an arcuate bottom recessed below a level of the second side of the second end of the base.

42. A method according to claim 34 further comprising forming at least one fastener receiving passageway through the first end of the base for connecting to the transformer conductor.

* * * * *